US008336463B2

(12) United States Patent
Smith

(10) Patent No.: US 8,336,463 B2
(45) Date of Patent: Dec. 25, 2012

(54) ZIPLINE TROLLEY SYSTEM

(75) Inventor: Kevin G. Smith, Whistler (CA)

(73) Assignee: Skyline Zipline Global, LLC, Vestal, NY (US)

( * ) Notice: Subject to any disclaimer, the term of this patent is extended or adjusted under 35 U.S.C. 154(b) by 0 days.

(21) Appl. No.: 13/264,760

(22) PCT Filed: Nov. 27, 2009

(86) PCT No.: PCT/CA2009/001748

§ 371 (c)(1),
(2), (4) Date: Oct. 17, 2011

(87) PCT Pub. No.: WO2011/063494

PCT Pub. Date: Jun. 3, 2011

(65) Prior Publication Data

US 2012/0031296 A1 Feb. 9, 2012

(51) Int. Cl.
*B61B 7/00* (2006.01)

(52) U.S. Cl. ..... 104/113; 104/112; 104/115; 104/53; 105/148

(58) Field of Classification Search ..... 104/112, 104/113, 115, 53; 105/148, 150; 472/122, 472/123

See application file for complete search history.

(56) References Cited

U.S. PATENT DOCUMENTS 245,893 A * 8/1881 Tunnington ..... 472/123
479,524 A * 7/1892 Nicholson ..... 472/123
547,528 A * 10/1895 Weaver et al. ..... 105/91
654,687 A * 7/1900 Suter ..... 104/22
1,087,062 A * 2/1914 Izett ..... 104/115
1,087,063 A * 2/1914 Izett ..... 104/115
1,228,694 A * 6/1917 Netcott ..... 472/120
1,490,619 A * 4/1924 Manikowske et al. ..... 472/120
1,873,196 A * 8/1932 Harris et al. ..... 104/112
2,812,010 A * 11/1957 Abdallah ..... 482/69
3,040,678 A * 6/1962 McEwen ..... 105/150
3,070,035 A * 12/1962 Russo et al. ..... 104/113
3,192,872 A * 7/1965 Parent ..... 104/93
3,480,272 A * 11/1969 Ziebart ..... 472/20
4,062,293 A * 12/1977 Davis ..... 104/113
4,159,113 A * 6/1979 Callecod ..... 482/36
4,948,118 A * 8/1990 Miraglia ..... 482/55
5,113,768 A * 5/1992 Brown ..... 104/112
5,224,425 A 7/1993 Remington
5,701,824 A * 12/1997 Johnson et al. ..... 104/112
5,904,099 A * 5/1999 Danneker ..... 104/53
5,931,100 A * 8/1999 Sutton et al. ..... 104/53
6,363,858 B1 * 4/2002 Voirin ..... 104/173.1
6,640,727 B2 11/2003 Ostrobrod (Continued)

FOREIGN PATENT DOCUMENTS

WO WO2009/143529 A2 11/2009

*Primary Examiner* — Jason C Smith
(74) *Attorney, Agent, or Firm* — ARC IP Law, PC

(57) ABSTRACT

A zipline trolley system comprises a cable, trolley, launcher, and a catch block. The launcher is fixed on the cable and comprises a substantially cylindrical inner body with a rigid outer body adapted to rotate about the inner body. A return spring attaches the inner body with the outer body. The catch block is also fixed on the cable and comprises a block with left and right retaining arms pivotably connected to the block and adapted to clasp onto the front plate of the frame of the trolley.

10 Claims, 3 Drawing Sheets

U.S. PATENT DOCUMENTS

| | | | | |
|---|---|---|---|---|
| 6,666,773 | B1 | 12/2003 | Richardson | |
| 7,381,137 | B2 * | 6/2008 | Steele et al. | 472/45 |
| 7,610,706 | B2 | 11/2009 | Pitcher | |
| 7,624,684 | B2 * | 12/2009 | Morris | 104/112 |
| 7,819,066 | B2 * | 10/2010 | Smith | 104/112 |
| 2002/0162477 | A1 | 11/2002 | Palumbo | |
| 2008/0178760 | A1 * | 7/2008 | Frangos et al. | 104/112 |
| 2008/0202375 | A1 * | 8/2008 | Quattlebaum | 104/112 |
| 2009/0223406 | A1 * | 9/2009 | Smith | 104/112 |
| 2011/0083577 | A1 * | 4/2011 | Tilley | 104/96 |
| 2012/0031296 | A1 * | 2/2012 | Smith | 104/113 |

* cited by examiner

ZIPLINE TROLLEY SYSTEM

FIELD OF THE INVENTION

The present invention relates to zipline trolley systems. More particularly, the invention relates to launching and braking devices for zipline trolley systems.

BACKGROUND OF THE INVENTION

Zipline trolley systems typically comprise a small trolley that rolls freely along a cable extended between two points. The two points are typically elevated from the ground, with the starting point elevated higher than the finishing point. At the starting point, the user is attached to a trolley (such as the one described in U.S. patent application Ser. No. 12/239,959, the contents of which are hereby incorporated by reference) and sent down the cable. The user is usually attached to the trolley through a number of steel carabiners. At the finishing point, the user is disengaged from the trolley. This system is simple, yet it is not always ensured that the user is placed in a loaded, secure position before the trolley is released from the starting point. This can lead to catastrophic results if improper connections are not detected before the trolley is released.

Some zipline trolley systems finish with a negative grade in order to implement so-called "gravity braking", wherein the trolley naturally slows down near the finishing point since it has to travel upwards. In such systems, it is necessary to have some means at the finishing point to hold the user when he or she reaches the finishing point in order to prevent the user from rolling back down the cable. In some instances, this would involve a person grabbing and hanging onto the user as he or she approaches the finishing point.

These added procedures at the departure and arrival of every zipline trolley both increase the length of time required for each user to experience the zipline system and complicate the process for starting and ending rides on the zipline trolleys. What is therefore required is a safe and simple system to launch and stop zipline trolleys.

SUMMARY OF THE INVENTION

According to one aspect of the invention, a zipline trolley system comprises a cable extended between a first point and a second point, a trolley, a launcher fixed to the first point, and a catch block fixed to the second point. The trolley comprises one or more wheels that travel on the cable and a frame attached to the one or more wheels, wherein the frame comprises a front plate and a back plate. The launcher comprises a substantially cylindrical inner body fixed to the first point, a rigid outer body adapted to rotate about the inner body, a return spring, and a retention mechanism. One end of the return spring is attached to the inner body and the other end of the return spring is attached to the outer body, wherein rotation of the outer body about the inner body tensions the return spring. The retention mechanism is connected to the outer body and adapted to clasp onto the back plate of the frame when the return spring is not tensioned.

The catch block comprises a block fixed to the second point, a left retaining arm and a right retaining arm, and a left spring and a right spring. The left retaining arm and the right retaining arm are both pivotably connected to the block and adapted to clasp onto the front plate of the frame.

One end of the left spring is attached to the block and the other end of the left spring is attached to the left retaining arm, wherein pivoting the left retaining arm away from the block tensions the left spring. Similarly, one end of the right spring is attached to the block and the other end of the right spring is attached to the right retaining arm, wherein pivoting the right retaining arm away from the block tensions the right spring.

The foregoing was intended as a broad summary only and of only some of the aspects of the invention. Other aspects of the invention will be more fully appreciated by reference to the detailed description of the preferred embodiment. Moreover, despite this disclosure, the actual invention, inventive apparatus, methods, concepts and inventive ideas for which this patent is sought are ultimately defined only by the formal claims of this application, not by the details of the summary or of the preferred embodiment.

BRIEF DESCRIPTION OF THE DRAWINGS

The invention will be described by reference to the detailed description of the preferred embodiment and to the drawings thereof in which.

DETAILED DESCRIPTION OF THE PREFERRED EMBODIMENT

Figure 1:
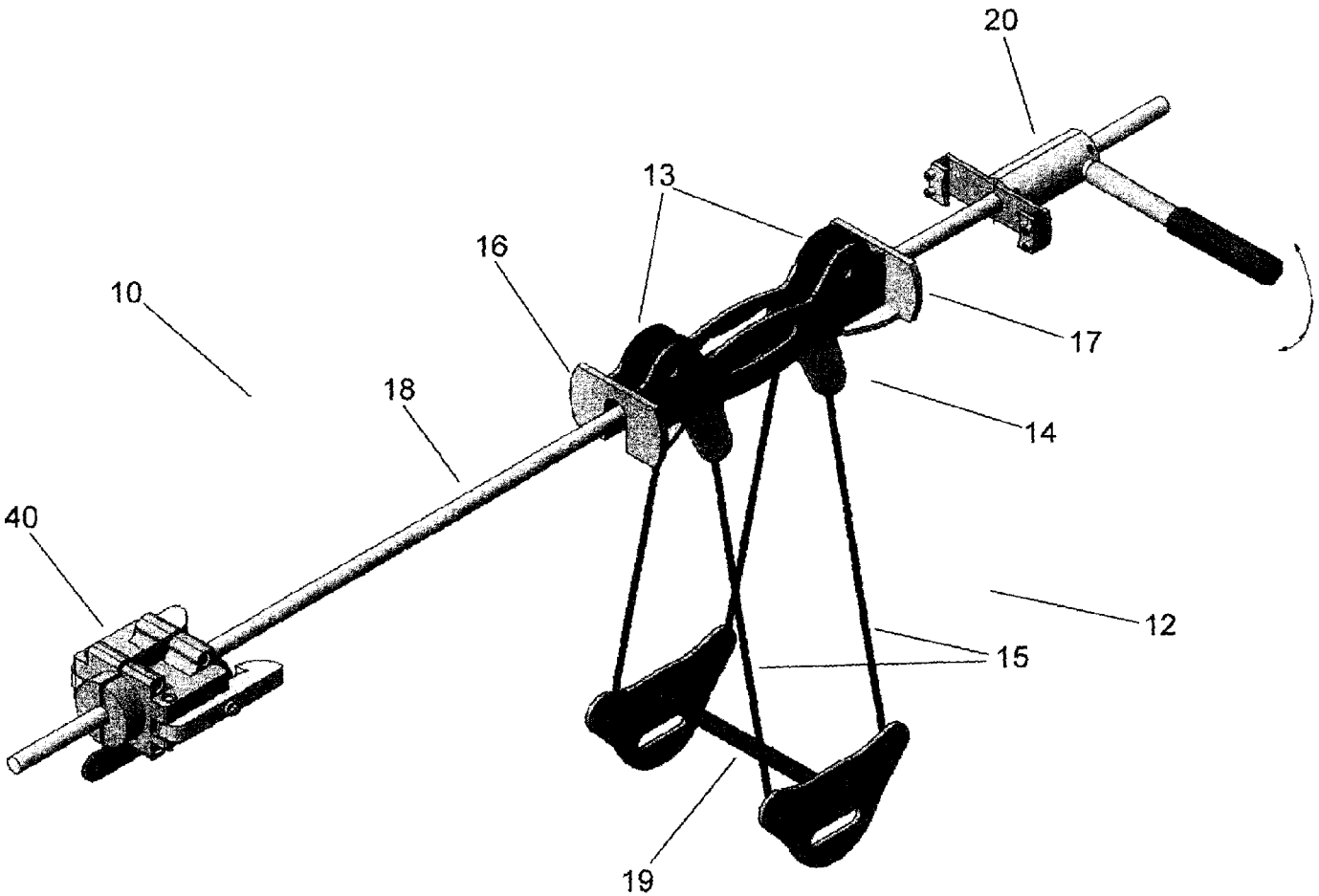
FIG. 1 is a perspective view of the zipline trolley system according to the preferred embodiment of the invention.

Referring to FIG. 1, the zipline trolley system 10 of the present invention comprises a trolley 12 that travels along a cable 18. At one end of the cable 18 is attached a launcher 20, which is used to start the trolley 12 moving along the cable 18. At the other end of the cable 18 is attached a catch block 40, which is used to stop the trolley 12. Preferably, both the launcher 20 and the catch block 40 are elevated above ground, with the launcher 20 elevated higher than the catch block 40 so that the trolley 12 will move, through gravity, from the launcher 20 to the catch block 40 along the cable 18.

The cable 18 may be a steel cable of any suitable diameter. Preferably, the diameter of the cable 18 is one inch or less. The trolley 12 comprises one or more wheels 13 enclosed in a frame 14. The wheels 13 travel on top of the cable 18, and lines 15 extend from the sides of the frame 14 to attach to a handle 19 that swings below the frame 14. The handle 19 is attached to a user using various connection mechanisms, such as harnesses and carabiners. A front plate 16 is attached to the front of the frame 14, while a back plate 17 is attached to the rear of the frame 14.

Figure 2:
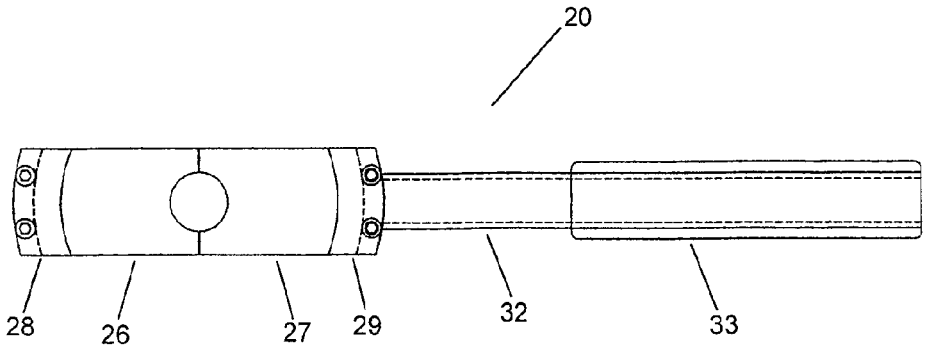
FIG. 2 is a front view of the launcher of the zipline trolley system of FIG. 1.
Figure 3:
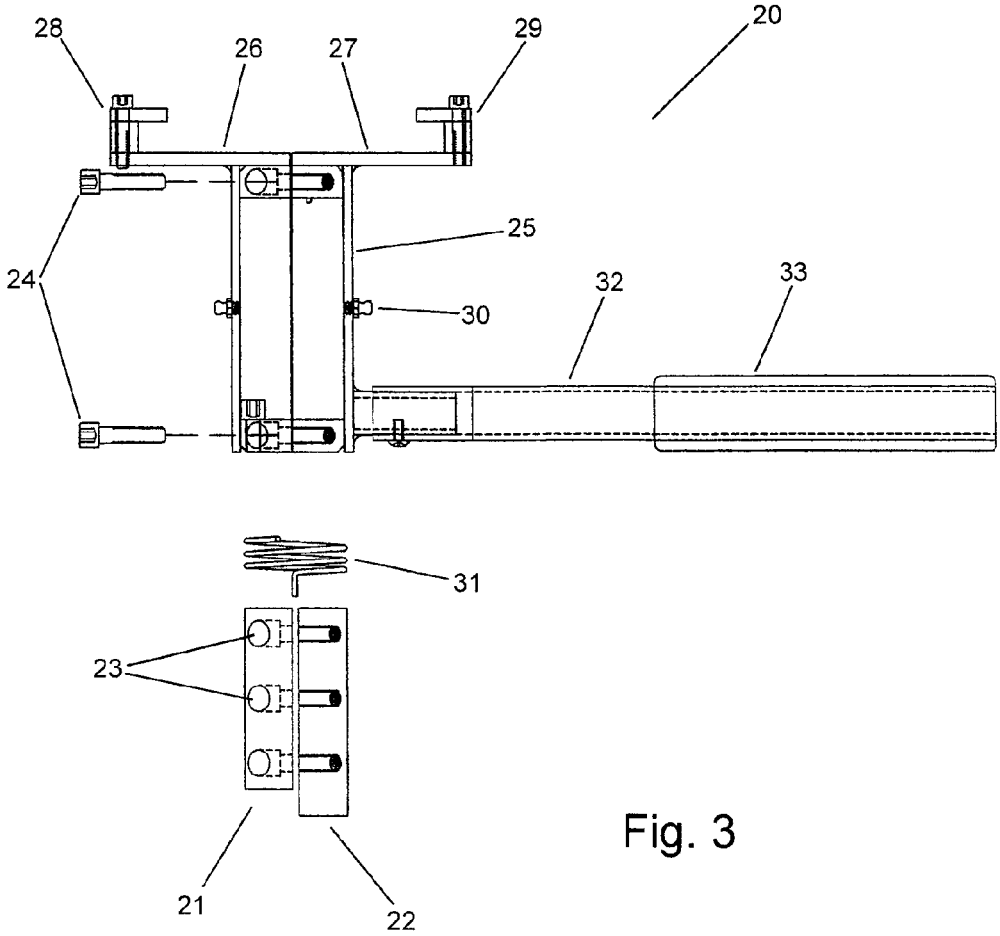
FIG. 3 is a cross-sectional exploded view of the launcher of FIG. 2.

Referring to FIGS. 2 and 3, the launcher 20 comprises two blocks 21, 22 that fit around a section of the cable 18. The two blocks 21, 22 are attached to each other by one or more connectors 23, such as screws or bolts. For example, the two blocks 21, 22 may be attached together by $5/16^{th}$ inch hex bolts. The connectors act to clamp the two blocks 21, 22 onto the cable 18 such that the blocks 21, 22 are unable to rotate about the cable 18. The two blocks 21, 22, when clamped to each other, form a generally cylindrical outer surface. The launcher 20 further comprises an outer body 25 that is able to rotate about the cylindrical outer surface of blocks 21, 22.

The outer body 25 is preferably constructed from metal and made of two pieces held together by outer connectors 24, such as $5/16^{th}$ inch×1¼ inch socket cap screws. On one end of the outer body 25 (the end that will release the trolley 12) are rigidly attached two flanges 26, 27 extending perpendicularly away from the longitudinal axis of the cable 18. Preferably, the flanges 26, 27 are constructed from steel and welded to the outer body 25. Retention jaws 28, 29 are rigidly connected to the ends of each of the flanges 26, 27. Preferably, the retention jaws 28, 29 made of a high-density polyethylene compound and are connected to attachment points on the flanges 26, 27 by $5/16^{th}$ inch×1¼ inch socket cap screws. The retention jaws 28, 29 are configured so that they fit around and grip the back plate 17 of the trolley 12. As the retention jaws 28, 29 come in direct contact with the trolley 12, they are designed to be replaceable and can removed by unscrewing the socket cap screws. Furthermore, the use of a high-density polyethylene compound for the retention jaws 28, 29 ensures that the back plate 17 of the trolley 12 is not excessively worn by repeated use of the launcher 20.

Since the inner surface of the outer body 25 rotates about the outer surface of the blocks 21, 22, the contact area between the two surfaces may be lubricated with grease. Grease may be injected into the contact area through a grease nipple 30 located on the outer body 25. The grease nipple 30 allows for periodic lubrication on the contact area while the launcher 20 is being operated in all weather conditions.

In addition to rotation of the outer body 25 about the blocks 21, 22, a return spring 31 connects the blocks 21, 22 with the outer body 25. One end of the return spring 31 is fastened to one of blocks 21, 22, with the other end of the return spring 31 secured to the inside of the outer body 25. The return spring 31 is preferably secured to the inside of the outer body 25 using a socket cap screw.

A handle 32 is attached to one side of the outer body 25. Preferably, the handle 32 is substantially cylindrical and is welded to the outer body 25. The handle 32 may also comprise a grip 33 that allows for the handle 32 to be easily grasped by hand.

The retention jaws 28, 29, the flanges 26, 27, the outer body 25, the return spring 31, and the blocks 21, 22 are arranged in such a manner so that the launcher 20 is initially in a position where the return spring 31 is not under tension, and the retention jaws 28, 29 and the flanges 26, 27 are arranged generally parallel to the ground. When the handle 32 is rotated about the longitudinal axis of the cable 18, the outer body 25 rotates about the blocks 21, 22 and tensions the return spring 31. As the flanges 26, 27 are rigidly connected to the outer body 25 and the retention jaws 28, 29 are rigidly connected to the flanges 26, 27, the rotation of the outer body 25 causes the flanges 26, 27 (and therefore the retention jaws 28, 29) to rotate as well. When the handle 32 is released, the return spring 31 returns to its initial configuration, causing the outer body 25 to rotate back into its initial position. As a result, the flanges 26, 27 and the retention jaws 28, 29 also return to their initial positions.

It is important that the components in the launcher 20 are configured so that they are placed on the cable 18 after it is tensioned, and spheltered sockets are installed at each end of the cable 18 so that it is impossible to slip the launcher 20 on the cable 18 after cable installation.

Figure 4:
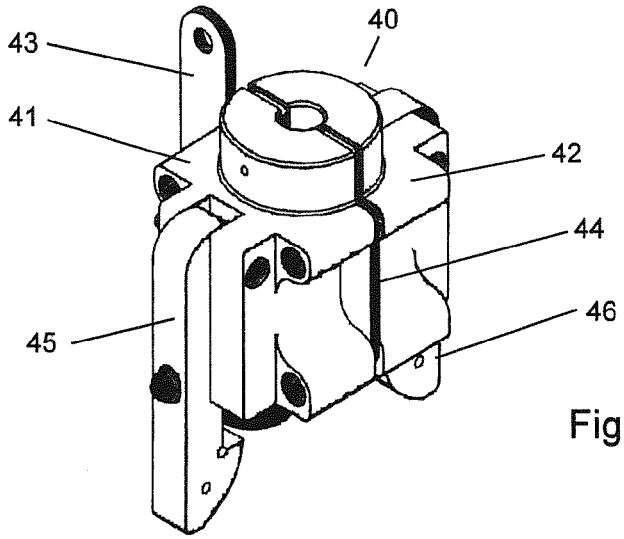
FIG. 4 is a perspective view of the catch block of the zipline trolley system of FIG. 1.
Figure 5:
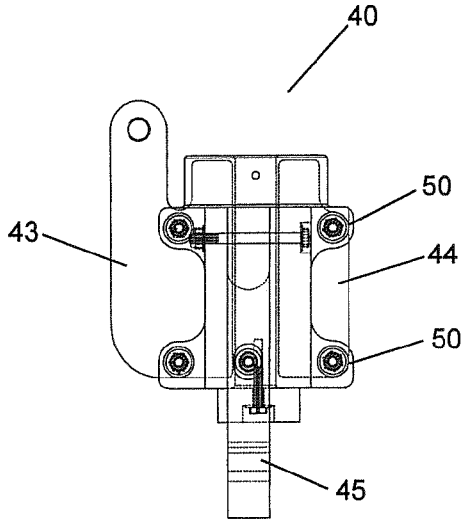
FIG. 5 is a side view of the catch block of FIG. 4.
Figure 6:
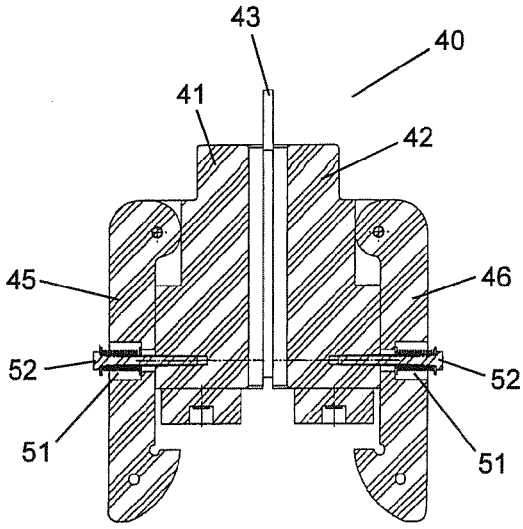
FIG. 6 is a front cross-sectional view of the catch block of FIG. 4.

Referring to FIGS. 4, 5, and 6, the catch block 40 comprises a left block 41 and a right block 42 separated by a first plate 43 and a second plate 44. The first plate 43 and the second plate 44, along with the left block 41 and the right block 42 are held together by catch block connectors 50, such as stainless steel bolts. The catch block connectors 50 clamp the left block 41 and the right block 42 about the cable 18 and hold the catch block 40 rigidly in place on the cable 18. Preferably, the left block 41 and the right block 42 are constructed from high density polyethylene, and the plates 43, 44 are constructed from aluminium. The plates 43, 44 provide structural strength to the catch block 40. One end of a left retaining arm 45 is pivotably connected to the left block 41 while the other end comprises a hook-like structure with a tapered tip. Similarly, one end of a right retaining arm 46 is pivotably connected to the right block 42 while the other end comprises a hook-like structure with a tapered tip.

Each of the left retaining arm 45 and the right retaining arm 46 are attached to one end of two springs 51, with the other end of the two springs 51 attached to the left block 41 and the right block 42 respectively. The springs 51 are attached in such a manner so that opening the left retaining arm 45 and the right retaining arm 46 (i.e. pivoting them away from the left block 41 and right block 42 respectively) causes the springs 51 to tension. Referring specifically to FIG. 6, this may be achieved using compression springs. For the left retaining arm 45, for example, one end of the compression spring would be attached to the outer surface of the left retaining arm 45. A screw 52 would be provided that passed through the left retaining arm 45 and into the left block 41. The other end of the compression spring would be attached to the tip of the screw 52. As a result, pivoting of the left retaining arm 45 away from the left block 41 would result in tensioning and compression of the compression spring.

When the edge of the front plate 16 of the trolley 12 impacts the tapered tips of the left retaining arm 45 and the right retaining arm 46, the momentum of the trolley 12 causes the left retaining arm 45 and the right retaining arm 46 to open (thereby tensioning the springs). However, once the edges of the front plate 16 completely passes over the hook-like structures of the left retaining arm 45 and the right retaining arm 46, the springs relax, causing the left retaining arm 45 and the right retaining arm 46 to quickly close, preventing the front plate 16 from moving back towards the launcher 20.

As most cables 18 have a certain degree of rise at this point, the catch block 40 ensures that the trolley 12 does not roll back down the cable 18 (towards the launcher 20). The catch block 40 also has the capacity to hold a large mass in a stationary position, allowing the user to be easily released from the trolley 12 without needing to be held by another person. The trolley 12 can be removed from the catch block 40 by rotating it 90 degrees about the longitudinal axis of the cable 18. Since the width of the front plate 16 is greater than its height, once the trolley 12 is rotated 90 degrees, the left retaining arm 45 and the right retaining arm 46 can no longer maintain contact with the front plate 16. Preferably, a pillow 47 is attached to the front of the left block 41 and the right block 42 to dampen the impact of the front plate 16 on the left block 41 and the right block 42. The pillow 47 may be made of a rubber compound.

The zipline trolley system described above enhances the safety of using a zipline trolley. The launcher 20 allows the trolley to be placed on the cable without the need for any leash mechanism and safely holds the weight of the trolley 12 and user in a fully loaded position. The user can hang freely from the trolley 12 while the necessary safety connections are inspected. The user can be easily launched by rotating the handle 32. It is not necessary to unload the user from a safety tether and to alter the weight of the user at this point of the launch process. Furthermore, the user can no longer release himself or herself as the launcher 20 is located behind and out of the reach of the user.

The catch block 40 allows a user to stop without the need for another person to grab and hold onto the user. The catch block 40 attaches to the trolley 12 with spring-tensioned jaws and will hold the trolley 12 in place so that the user can be easily disengaged from the trolley 12. Both the launcher 20 and the catch block 40 automatically reset themselves after use, easily allowing for the continuous use of the zipline trolley system from one user to the next.

It will be appreciated by those skilled in the art that the preferred and alternative embodiments have been described in some detail but that various modifications may be practiced without departing from the principles of the invention.

The invention claimed is:

1. A zipline trolley system comprising:

a cable extended between a first point and a second point;

a trolley comprising:

one or more wheels that travel on said cable; and a frame attached to said one or more wheels, wherein said frame comprises a front plate and a back plate;

a launcher fixed to said first point and comprising:

a substantially cylindrical inner body fixed to said first point;

a rigid outer body adapted to rotate about said inner body;

a return spring, wherein one end of said return spring is attached to said inner body and other end of said return spring is attached to said outer body, and wherein rotation of said outer body about said inner body tensions said return spring; and a retention mechanism connected to said outer body and adapted to clasp onto said back plate of said frame when said return spring is not tensioned; and a catch block fixed to said second point and comprising:

a block fixed to said second point;

a left retaining arm and a right retaining arm, both pivotably connected to said block and adapted to clasp onto said front plate of said frame;

a left spring, wherein one end of said left spring is attached to said block and other end of said left spring is attached to said left retaining arm, and wherein pivoting said left retaining arm away from said block tensions said left spring; and a right spring, wherein one end of said right spring is attached to said block and other end of said right spring is attached to said right retaining arm, and wherein pivoting said right retaining arm away from said block tensions said right spring.

2. The zipline trolley system of claim 1, wherein said inner body comprises two substantially semi-cylindrical portions clamped to each other on said first point on said cable.

3. The zipline trolley system of claim 2, wherein said two substantially semi-cylindrical portions are clamped to each other using screws.

4. The zipline trolley system of claim 1, wherein said launcher further comprises a handle rigidly attached to said outer body.

5. The zipline trolley system of claim 1, wherein said retention mechanism comprises:

two opposing flanges, wherein one end of each of said flanges is rigidly connected to said outer body, and wherein said flanges extend perpendicularly from the longitudinal axis of said cable; and two retention jaws, wherein each retention jaw is connected to other end of each of said flanges, and wherein said retention jaws are configured to clasp onto said back plate of said frame.

6. The zipline trolley of claim 5, wherein said retention jaws are removably connected.

7. The zipline trolley of claim 5, wherein said retention jaws are constructed from a high-density polyethylene compound.

8. The zipline trolley of claim 1, wherein one end of each of said left retaining arm and right retaining arm is tapered.

9. The zipline trolley of claim 8, wherein said end of each of said left retaining arm and right retaining arm further comprises a hook.

10. The zipline trolley of claim 1, wherein said outer body further comprises a grease nipple to allow for supplying grease to the interface between said outer body and said inner body.

* * * * *